United States Patent [19]

Smith

[11] Patent Number: 4,728,100

[45] Date of Patent: Mar. 1, 1988

[54] EXERCISE PACER

[76] Inventor: Robert S. Smith, 1263 Emory St., San Jose, Calif. 95128

[21] Appl. No.: 839,085

[22] Filed: Mar. 13, 1986

[51] Int. Cl.[4] ..... A63B 21/00

[52] U.S. Cl. ..... 272/93; 272/DIG. 5; 434/247; 340/323 R

[58] Field of Search ..... 272/93, DIG. 5; 434/247, 255; 340/323 R

[56] References Cited

U.S. PATENT DOCUMENTS

| | | | |
|---|---|---|---|
| 4,028,693 | 6/1977 | Kuntz | 434/255 |
| 4,099,713 | 7/1978 | Spector | 272/93 |
| 4,186,388 | 1/1980 | Robinson | 340/323 R |
| 4,216,956 | 8/1980 | Yamamura et al. | 340/323 R |
| 4,408,183 | 10/1983 | Wills | 272/DIG. 5 |

*Primary Examiner*—Leo P. Picard

[57] ABSTRACT

A device for pacing a series of exercise repetitions whereby, in one mode, the user interrupts a light beam with each repetition and a light signal indicates if the period for each repetition is longer than a preset value. In a second mode, the user performs a single event beginning at a position remote from the light beam and finishes the event by interrupting the light beam and a signal light indicates if time for the single event is longer than a preset period.

6 Claims, 11 Drawing Figures

EXERCISE PACER

BACKGROUND OF THE INVENTION

1. Field of the Invention

This invention relates to the field of equipment to assist in the performance of exercises.

2. Prior Art

The three elements involved in the performance of an exercise routine are the force of the exertion, the speed of the exertion, and the number of repetitions. There are many devices available for providing an appropriate force—barbells, rowing machines, springs, machines constructed with pulleys and weights, etc.—each device being configured to exercise particular muscle groups of the body. The stopwatch has received widespread use as a device for measuring speed of exertion, e.g., running speed over a given distance, swimming speed over a given distance, etc. Such measurements are applied to the timing of a number of exertions. However, this method of measuring speed informs the athlete of his speed only after the exercise has been completed.

For many years, physiologists and coaches believed that an athlete's so-called reaction time—the maximum time to contract a given muscle group—was determined primarily by genetic factors. The belief was held that an athlete's strength could be increased by performing resistance exercises but that his reaction time could not be affected significantly by traning. This widely held opinion has changed, however, and some coaches have adopted unusual approaches to training for faster reaction time. For example, some sprinters train with a ling rubber band which they stretch out on a field to distances of 50 meters. The runner sprints and is simultaneously pulled by the rubber band "to make his legs run faster". Another technique has been for an athlete to sprint while holding onto a moving automobile. There is nothing very quantitative about these methods however so their application has been limited.

A timing device which has arrived on the market place recently is the "Audostart". This device records the times required by an athlete to run the intervals of a distance by detecting his position with a photocell at each interval.

A training concept whose importance and practice has gained prominence in recent years is "isolation". By isolation is meant identifying one of the various muscle groups that are active in a given athletic maneuver and then performing exercise that "isolates" on that muscle group—that is an exercise in which that muscle group is the major group performing the exercise. For example, in sprinting, the muscle groups that are active include the hip flexors and extensors as well as the muscles of the calves, shoulders, back and abdomen. When an athlete sprints, the heart and lungs are the first to tire so that none of these groups are exerted to their capacity. Therefore, in order to build the hip flexors and extensors at maximum rate, an exercise is performed such as standing on one leg and bringing the second leg up and down at the fastest rate possible in order to fully exert the hip extensors and flexors of that leg.

Another aspect of the training phenomenon and the performance of athletic events is the onslaught of fatigue as the number of repetitions is increased with the result that the exercise is performed incorrectly. For example, when an athlete is performing the leg lift exercise as discussed in the previous paragraph, then as he tires, he fails to bring his knee up as high as required for optimum running form even though he may "believe" he is bringing his knee up. Furthermore, because of the differences in heights of the athletes, one athlete must bring his leg up to a different height than another athlete for proper performance of the exercise.

Other exercises that isolate on special muscle groups that are especially beneficial for developing sprinting speed are arm swings in which the legs are stationary. Again, when the arms are swinging and the legs are stationery, the cardiovascular and respiratory system does not tire so readily so that the swinging of the arms and shoulders can be exerted to maximum capacity.

Yet another aspect of the training phenomena is that, in the performance of very fast repetitions (such as stationery running drills or swinging the arms as if running) the athlete loses the count of his repetitions, and in any event, the extra chore of counting his repetitions at a very fast rate detracts from his ability to concentrate on increasing his rate of repetitions.

The principle of biofeedback has been used in a number of techniques to modify human performance. For example, it is well known that, with some practice, a human can change such functions as pulse rate, blood pressure, etc., simply by looking at the meter presenting the body measurement. Furthermore, it is widely accepted that if an athlete is able to measure his performance while he is performing the exercise, he is subjected to greater motivation to improve. This is the reason that an athlete generally runs faster in a race with other runners than by himself.

The exercises discussed in the foregoing paragraph were characterized by fast repetitions in which the beginning and ending position of each repetition was identical. The requirement for monitoring in this type of exercise is to be informed at the end of each repetition that the repetition has been completed within a desired interval of time so that the athlete can respond with greater effort as indicated while the exercise is in progress. Another type of exercise is where the athlete is performing a number of repetitions where the intention is not to complete a number of repetitions quickly but to perform each repetition quickly but to pause for a brief time between repetitions. For example, in a vertical jumping exercise, (such as for basketball players) the objective would be to jump as high as one can (as determined by the time off the floor) rather than how fast one can jump.

Still another type of monitoring is illustrated by a short sprint, where only one repetition is performed and the beginning and end positions are different. Furthermore, in this type of exercise, it is generally desireable to "hold" the monitor signal after the single repetition or event has been completed. For example, if a short sprint is completed in more than a preset time, this may be indicated by a light that would come on and stay on rather than simply flash briefly.

For the purpose of describing the invention, it will be useful to define and describe certain well known electronic components which are used in the construction of various embodiments of this invention.

A timer is defined to be an electronic component having a set of power terminals for receiving input power and one or more control switches. When power is applied to the power terminals, the control switches change state (open or close) for a period of time predetermined by a timer control, then revert to their initial state. In the context of this specification, terms "normally open" or "normally close" will refer to the initial state of the control switch before power is applied. With most commercial timers, the control switches are double throw, so that each switch has a "common" terminal and two additional terminals. In one switch position, the common terminal is connected to one terminal while in a second position, the common terminal is connected to the other terminal. The typical commercial timer has more than one control switch.

A delay line is defined to be identical to the timer except that the control switches remain in their initial state for a delay period after input power is applied and then switch to their second state and remain in that state until the input power is removed. The delay period is present by a manual control.

The delay line and timer are closely related components in the sense that for a particular application, the one may be substituted for the other with only minor modifications of the circuitry. This case of substitution provides for a number of means to accomplish the objectives of this invention as illustrated in the discussions that follow.

It is useful to differentiate further between the timer and the delay line by defining the signaling state of the control switch as being the position of the switch immediately after application of power and the state after the delay or timer period as the "nonsignaling" state. In accordance with this definition, the control switches of the timer are in the "nonsignaling" and the control switches of the delay line are in the "signaling" state when no power is applied to the power terminals.

Timers and delay lines of the type described are manufactured by the National Controls Corp., Lombard, Ill.

A photocell is defined to be an electronic component consisting of a light source that emits a beam of light and a sensor of the light beam. The sensor may be the retroreflective type wherein the sensor is located close to the light source and the beam crosses a distance where it is reflected back to the sensor. In the direct type, the sensor and light source may be located at opposite ends of the light path. The photocell may also have one or more control switches. Each switch of the typical commercial photocell is commonly a "double throw" switch and so has a common terminal and a first and second switch terminal. When the light beam is incident on the sensor, the switches will be in one state in that the common and first terminals will be connected whereas if the light beam is not incident on the sensor, then the switches are in the second state in that the common and second terminals are connected.

Photocells of the type described are manufactured by Microswitch a division of Honeywell, Minneapolis, Minn.

Yet another component that may be incorporated into various embodiments of this invention is the electronic stopwatch.

One type of electronic stopwatch will be referred to in this specification as a "pulsed" stopwatch. The "pulsed" stopwatch construction has a first, second and third stopwatch terminal and may be turned on or off if the first and second stopwatch terminals are connected momentarily. If the first and third stopwatch terminals are connected momentarily, the stopwatch time is reset to zero.

Stopwatches of the type described are distributed by DICK SMITH ELECTRONICS, with an office in Redwood City, Calif.

A second type of electronic stopwatch will be referred to in this specification as the "powered" stopwatch. This stopwatch is a pulse generator having an off-on terminal such that when power is applied continuously to the stopwatch terminals, a continuous stream of pulses is generated and the number of pulses is displayed as an indication of lapsed time. When the applied power is shut off (momentarily), pulse generation ceases and the generator is latched so that counting is not resumed after power comes on after the interruption A electric counter is a component having a readout of numbers and a terminal for receiving electric pulses. When a pulse is received, the readout is increased by one digit. Means are also provided (usually as a push button) to reset the readout to zero manually.

Counters are manufactured by IVO Industries, Eatontown, N.J.

A latch is a combination of circuit elements with feedback which can be used to maintain power to a component such as when power is applied to the component through a momentary switch. One commonly used latch is a relay having a coil which closes a switch when energized. The relay switch is in parallel with the momentary switch. The relay coil is in series with the power source, the momentary switch and the component. When the momentary switch is closed, power is supplied to the component and the relay is energized so that the relay switch is closed. Even after the momentary switch is opened, power passes through the closed relay switch through the relay coil so that the relay switch is held closed. Power to the component is thereby maintained. In addition to relay latches, Integrated Circuit latches are also available from manufacturers of semiconductor deices such as National Semiconductor, Santa Clara, Calif.

SUMMARY OF THE INVENTION

It is an object of this invention to monitor the various activities of an athlete which include the ability to provide a signal indicating to the athlete his reaction time (or speed) of each repetition of a series of repetitions while the athlete is performing the repetitions.

It is a futher object of this invention to indicate to the athlete when he is failing to perform an exercise correctly.

It is a further objective of this invention to inform an athlete as to how many repetitions during a given period that he has performed an exercise correctly.

Another mode of monitoring relates to measurements of single events in which the beginning and ending positions of the athlete are different and where it is desired to hold the signal after completion of the event.

The various techniques of monitoring the athlete's activity provide a training means for decreasing reaction time of an athlete in the performance of an exercise in which the athlete responds to a signal indicating performance by improving his performance in accordance with the principles of the wellknown biofeedback phenomenon.

The essential concept of this invention is a means for signalling the end of a preset "pacer" period after the beginning of a repetition if the preset "pacer" period is less than the time required to perform the repetition (i.e., the "repetition" period) or if the repetition is performed incorrectly.

Accordingly, one arrangement of the apparatus is a photocell consisting of a light source on a support so as to provide a horizontal (photocell) beam whose height from the ground may be adjusted depending on the size of the athlete, the exercise, etc. When the beam is uninterrupted, it is incident on a sensor positioned so that the athlete can exercise between the source and sensor. When the athlete assumes an appropriate position momentarily at the beginning and end of a repetition a part of his body (e.g. the arm or leg) will interrupt the light beam thereby causing the sensor and associated circuitry to close a "photocell" switch with each interruption. (An alternate arrangement would be for a part of the athlete's body to momentarily interrupt and reflect the light beam which would be detected by the sensor.)

In one mode of operation, the photocell switch is connected between a source of power and the power terminals of a delay line so that the closing of the photocell switch applies power to the power terminals of a delay line thereby initiating the first "pacer" period which is the delay period of the delay line. If the light beam is not interrupted (by completion of a repetition) then a "normally open" control switch of the delay line will close at the end of the "pacer" period and admit power to a "repetition" light. If the photocell light beam is interrupted by completion of a repetition before the end of the "pacer" period, then the photocell switch will open and interrupt power to the delay line. This causes the delay line to reset so that the control switch of the delay line will remain open and a new delay period is initiated. Therefore, if the athlete performs his repetitions fast enough, the control switch will remain in a nonsignaling state and the "repetition" light will not come on.

If the control switch of the delay line is "normally closed" then the "repetition" light will remain on during the repetition and go off only if the "repetition" period is longer than the preset "pacer" period. In this instance, the nonsignaling state of the control switch corresponds to the "repetition" light being lit. If the control switch is "normally closed", then the "repetition" light will remain off as long as the "repetition" period is shorter than the preset "pacer" period.

For purposes of this invention, the term, "signaling means emits a signal", is defined as a device whose change of state is perceptible to the user, such as a light turning from off to on or turning from on to off.

In the foregoing paragraphs, an intermittent signal was generated with each repetition when the repetition was longer than the preset pacer period. For this purpose, the power terminals of the delay line were connected through the photocell switch to the power source.

An advantage with this arrangement is that the athlete may pause between repetitions for any desired period as long as he is blocking the beam in his resting position.

It is also very useful to be able to use the same apparatus to monitor a single event in which the beginning position is different from the final position. For this purpose, it is also desireable to have the signal remain in its state at the instant of completion of the single event. For example if the athlete performed a single event and the event time was longer than the preset "pacer" period, then it would be desireable to have the signal stay "on" rather than "blink" once. For this "single event" mode, power is supplied through the photocell switch to the parallel connection of the photocell terminal and to one of a set of terminals of a two pole "starter" switch whose other terminal is connected to a delay line input terminal. The delay line terminal is also connected to power through one set of terminals of the double pole control switch of the delay line. The second set of terminals of the control switch connects power to a signal light.

The starter switch may be a button in a sprinter's starting block. The photocell light beam is located at the finishing point. The "starter" switch is momentary in the starting position and is held closed before the event so as to apply power to the photocell with the delay line input disconnected. Thus the photo cell light will come on and latch the photocell switch closed before the event starts.

The athlete starts the single event by releasing the starter switch. When the starting switch is released, it switches to its second (or "normal") position, closing its second set of terminals and thereby applying power to the input terminals of the delay line so as to start the pacer period.

If the period for the single event exceeds the pacer period, the control switch closes and the signal light switches state. Power is also maintained to the delay line input so that the state of the signal light is maintained regardless of the condition of the photocell switch.

When the single event period is shorter than the preset pacer period, the photocell switch opens thereby turning off both the delay line and the photocell light so that the initial state of the signal light is maintained.

A "mode" switch may be incorporated into the circuit which is a double pole double throw switch permitting use of the circuit to monitor repetitions in a first switch position or single events in a second switch position.

In the "repetition" position, the "mode" switch connects the photocell light directly to power through one set of terminals. In this position it also disconnect power to the control switch through its second set of terminals so that the delay line will not "latch" at the end of the pacer period as discussed above. The starter switch will be in the normal position so that the photo cell switch will control power to the delay input. Therefore the circuit will function as described above for monitoring repetitions.

In the "single event" position, the mode switch connects the photocell light to power through the photocell switch and connects power to the control switch of the delay line so that the circuit operates as discussed above in connection with the circuit for monitoring single events.

The foregoing arrangements enable the athlete to monitor himself without the assistance of a second person.

The crux of the invention is the combination of a photocell, delay line and signal light and two switches to monitor a series of repetitions with an intermittent light and a single event by emitting a continuous signal. In the embodiment described, the signal was connected across control switch terminals that were normally open preceding the start of anevent or repetition and during the pacer period. It will be clear to one skilled in the art that an appropriate signal can also be recognized if the signal terminals are connected to power through normally closed control switch terminals so that the light will be on during the start of the repetition and will go off if the repetition time exceeds the pacer period. However, in this latter embodiment, the signal light will flicker when the repetition is completed before the end of the pacer period so it is not a preferred embodiment.

Similarly, a timer could be used with normally open or closed control switches and appropriate interpretation of the signal. However there would be a slight flicker of the signal light if the repetition ended during the pacer period be cause, in the timer, the control switches must reset to start the pacer period and this could be confusing to the athlete. Therefore the use of a timer is not a preferred embodiment.

In a further embodiment, (in addition to the "repetition" light) an "exercise" light is lit for a preset "exercise" period during which the athlete attempts to perform his complete set of repetitions. The device includes a "power" switch that the athlete closes as he begins the exercise. When the "power" switch is closed, thereby applying power to the power terminals of a timer, the timer control switch, which is normally open, changes state (closes) for a preset timer "exercise" period. During the "exercise" period, electric power is admitted through the timer control switch to the "exercise" light so that an athlete knows that he is performing his exercise during the preset "exercise" period. Power is also transmitted through the timer control switch so as to supply power to the circuit discussed in the foregoing paragraph.

An alternate circuit would be to substitute a delay line for the timer to turn on the "exercise" signal. In this case, the control switch of the delay line would be "normally" closed (in the absense of applied power) and stay closed during the "exercise" delay period so as to energize the "exercise" light.

A further embodiment is to admit power through the photocell switch to a counter to count the number of repetitions performed. (The counter is connected in parallel with the power terminals of the delay line or timer.) In certain exercise, such as lifting the knee to interrupt the light beam, the athlete may fail to lift his knee sufficiently high (as he tires) so that the counter will not post a count but the "repetition" light will come on. Therefore, in this case, the counter will post the number of repetitions (kneelifts) that have been performed correctly.

Yet another extension of this invention is the addition of a stopwatch to measure the time period of a repetition or a single event. This can be accomplished by connecting the first and second terminals of a "pulse" stopwatch across the common terminal and open terminal of the (double throw) first control switch. The preset pacer period is reduced to a small (negligible) value and the mode switch is set on the repetition mode. The watch is "set" by interrupting the beam so as to turn on the signal light. The stopwatch is set to zero. When the event begins, the first control switch will short circuit the first and second stopwatch terminals briefly due to the very short pacer period so as to start the watch. When the light beam is again interrupted at the end of the event, the first and second stopwatch terminals will again be shorted so as to stop the stop watch.

In order to reset the "pulse" stopwatch, the first and third terminals are connected through a manual "normally open" switch and the "pulse" stopwatch is reset when this switch is momentarily depressed.

If the terminals of a "power" stopwatch (see prior art for definition) are connected in parallel across the input terminals of the delay line or the terminals of the signal light, and the pacer period is set for a large value,, then the stopwatch will record the length of time of a single repetition or event since the photocell light beam is interrupted at the start and finish of that repetition.

DETAILED DESCRIPTION OF PREFERRED EMBODIMENTS

Figure 1:
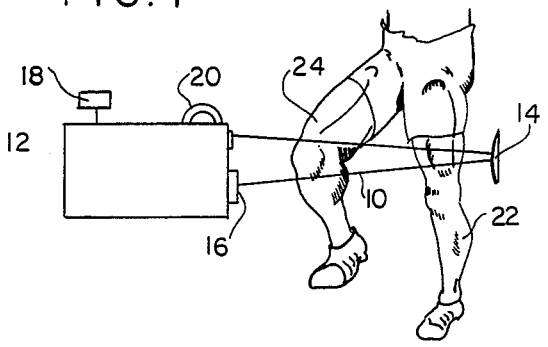
FIG. 1 is a partial view of an athlete performing with a device of this invention.

Turning now to a more detailed description, in FIG. 1 is shown an arrangement wherein a photocell light beam 10 originates from a photocell container 12 and is reflected from a reflector 14 back to the container 12 where it is incident upon a photocell sensor 16. The container has control knob 18 for presetting a "pacer" period and a "repetition" light 20 in view of an athlete whose legs 22 and 24 are shown. The leg 24 is close to interrupting the photocell beam 10 as he performs a one legged knee lift. If the athlete does not perform each leglift within the preset "pacer" time (determined by the position of the control knob 18) then the "repetition" light 20 will signal.

Figure 2:
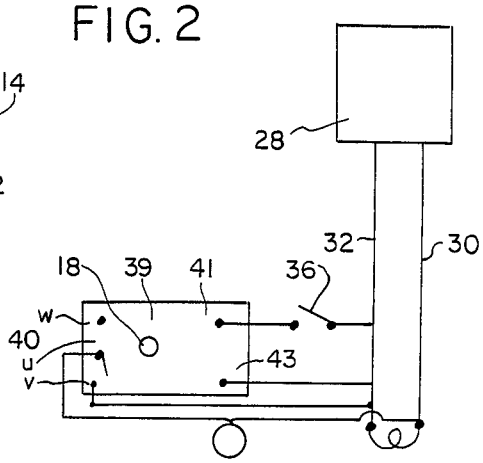
FIG. 2 shows the "repetition" circuit including the photocell for detecting the positions of the exercise, timing and signalling means.

In FIG. 2 is shown the "repetition" circuit 100 for the foregoing arrangement of FIG. 1. There is shown power admitted from power source 28 through conductors 30 and 32 to the terminals **34*a* and 34*b* of photocell light source 34 which lights and closes photocell switch 36. Closure of photocell switch 36 admits power from conductors 30 and 32 to the power terminals 41 and 43 of delay line 39. A "pacer" period will start when photocell switch 36 closes. The pacer period is preset by control knob 18. If the athlete does not lift his knee so as to interrupt the photocell beam 10 (FIG. 1) at about waist height before the expiration of the "pacer" period, then terminal 40*u* will connect to terminal 40*v* of "normally open" control switch 40, thereby passing power from conductors 30 and 32 to "repetition" light 20. This immediately informs the athlete that he is not lifting his leg fast enough. When the athlete lifts his leg so as to interrupt the photocell beam 10, the photocell switch 36 will open and reset the delay line 39. Thus, the "repetition" light 20 will stay off during the set of repetitions as long as the athlete performs his repetitions faster than the "pacer" period which is preset by an adjusting means represented in FIGS. 1 and 2 by the control knob 18 and which is a part of the delay line, 39**.

In another embodiment, if control switch 40 is "normally closed" the signal light 20 is turned on at the start of each repetition and will stay on if the repetition period is shorter than the preset "pacer" period and will go off if the "repetition" period is longer than the "pacer" period.

Figure 3:
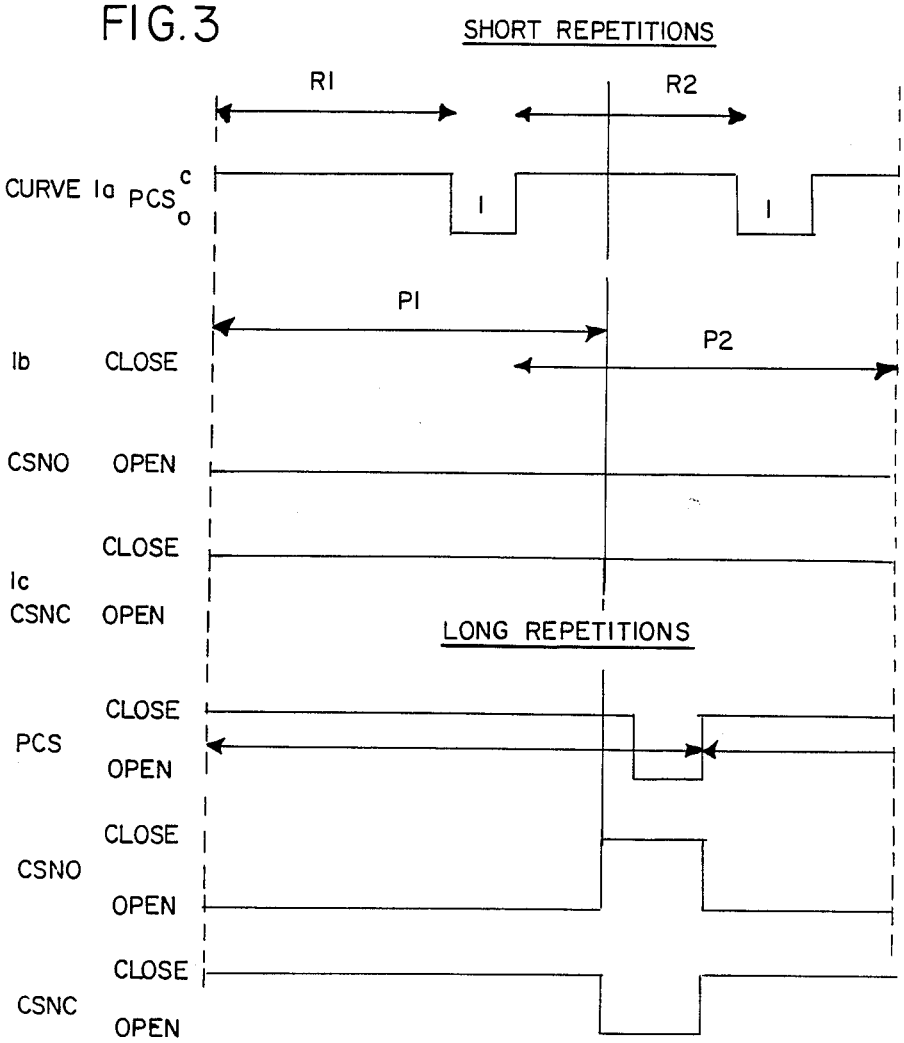
FIG. 3 shows the time dependent signal status for the various circuits that are included as embodiments of this invention.

The functions of the preceding two arrangements are illustrated in FIG. 3 for the case where the "repetition" period exceeds the "pacer" period and the case where the repetition period is less than the "pacer" period. Starting from the top, the first and second "repetition" periods are represented by abscissa segments R1 and R2, respectively. The first and second "pacer" periods are represented by absicissa segments P1 and P2 respectively. Using the abbreviations—

| | | |
|---|---|---|
| Photo cell switch - PCS<br>Normally open - NO<br>O - open | Control switch - CS<br>Normally closed - NC<br>C - closed | Signal light - SL<br>(when no applied power) |

by— curve 1 a,b and c when the repetition period is shorter than the pacer period.

curve 1 d,e and f when the repetition period is longer than the pacer period.

Figure 4:
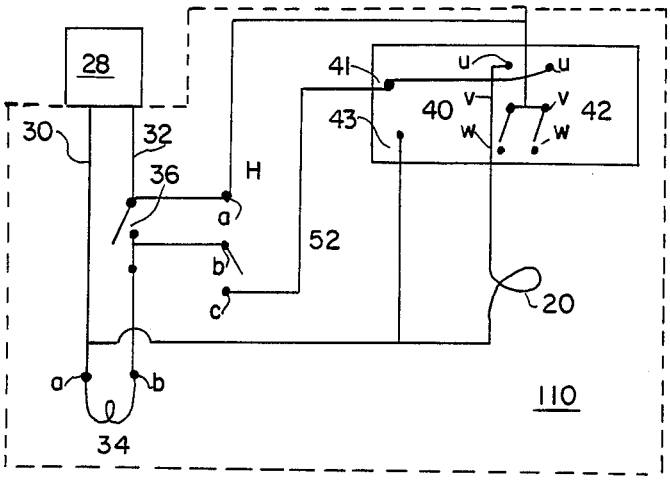
FIG. 4 shows the circuit modification to "hold" the signal resulting from monitoring a single event.

If it is desired to monitor a single event whose beginning position is remote from the photocell beam (e.g., a short spring) and to hold the signal after completion of the event, then the same components may be used as in circuit 100 but with some modification and the incorporation of a "starter" switch 52 as shown in circuit 110 of FIG. 4. The "starter" switch is a double throw switch 52 and is positioned at the starting location. This switch is momentary in one position (H) in which power input to the delay line terminal 41 is disconnected. In this momentary position, photocell light terminal **34*b* is shown connected to power terminal 32 through the closed set of contacts 52*a* and *b*. Thus, before starting the single event, the switch 52 is held in the momentary position (H) in order to turn on the photocell light beam 34 and latch the photocell switch 36 closed. When the momentary starter switch 52 is released to start the event, terminals 52*c* and *b* close so as connect delay terminal 41 to power through the photocell switch 36. If the single event period is shorter than the pacer (delay) period, the photocell switch 36 will open and interrupt power to both the photocell light 34 and the delay input terminals 41 thereby holding the signal light 20** "off".

The second set of terminals **42*u* and 42*v* of control switch 42 are shown connecting power line 32 to power terminal 41 of delay line 39. (In commercial delay lines, the control switch is double pole.) Therefore, if the single event exceeds the pacer period, control switch terminals 42*u* and 42*v* will close at the end of the pacer period and maintain power to the delay line 39 so that the delay line 39 will not reset when the photocell switch 36** is opened and then closed. Thus, the signal light will stay on.

The "signal" evoked by light 20 to indicate a "single" event period longer or shorter than the preset pacer period depends on whether control switch terminals **40*u* and *v* are "normally open or closed" when no power is applied to the power terminals 41 and 43**. The choice is an arbitrary one, usually, because with commercial delay lines, the control switch is generally double pole double throw.

Figure 5:
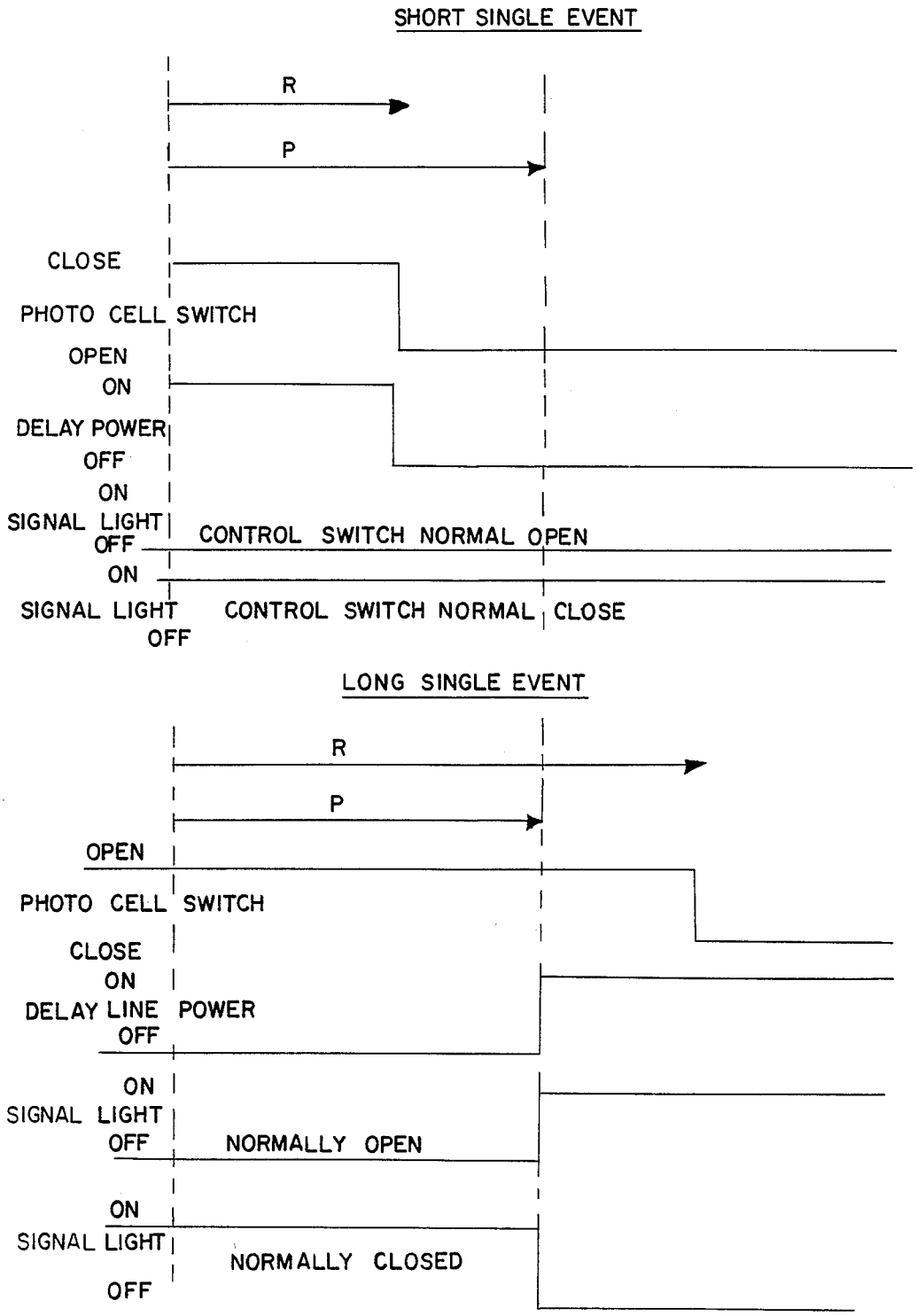
FIG. 5 shows the status versus time of the photocell switch, control switch and signal light for various embodiments of the "single event" circuit of figure four.

Signal responses for short and long repetition periods for circuit 110 are presented in FIG. 5. Starting from the top of FIG. 5, the groups of curves are presented where each group represents the indicated selected component conditions and each curve represents the status (open or closed) of the indicated switch as a function of time (abscissa), relative to when power was applied to the circuit (the dotted ordinate), and when the photocell beam was interrupted to mark the end of the single event (R) relative to the end of the "pacer" period (P).

By comparing within each group the SL status versus time for the long and short event, it is obvious that any selection of control switch condition (open or closed) could be used to monitor the single event in accordance with the invention.

Figure 6:
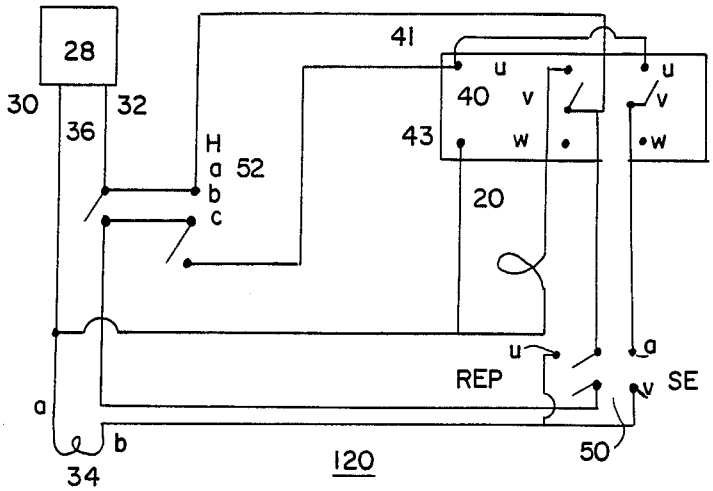
FIG. 6 shows a combination of the circuits of FIGS. 2 and 4 by incorporating a mode selection switch.

In FIG. 6 is shown the circuit 120 which permits the monitoring of repetitions as in circuit 100 or single events as in circuit 110. This is accomplished by modifying circuit 110 by incorporating a double pole double throw "mode selection" switch 50 which is in the "repetition mode" in one position and the "singleevent" mode in its second position. Terminal **34*b* is connected to power line 32 when switch 50 is in the "rep" position so as to close terminals 50*u* and 50*v*. When switch 50 is in the SE or "single event" position, then photocell terminal 34*b* is connected to powerline 32 through the photocell switch 36. The other pole 50*a* of switch 50 connects the control signal terminal, 42*u* to power line 32 when switch 50** is in the SE position.

Figure 7:
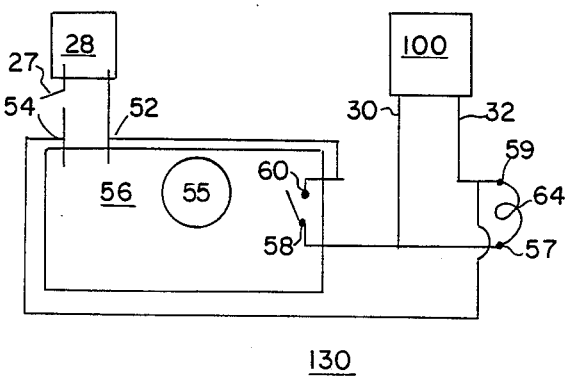
FIG. 7 shows the incorporation of a timer and "exercise" light into the repetition circuit of FIG. 2 for the purpose of monitoring the exercise period.

In FIG. 7 there is shown a circuit 130 which includes an "exercise" light 61 which comes on for a preset "exercise" period during which the athlete attempts to complete his set of exercise repetitions.

Circuit 130 includes "repetition" circuit 100 or 120 but additionally includes another component 56 which may be a timer with a normally open control switch or a delay line with a normally closed control switch and having control switch terminals 58 and 60. Considering first the example where 56 is a timer there is shown the source of electrical power 28 connected through the "normally on" power switch 27 to the power terminals 52 and 54 of a timer 56. "Control switch" terminal 58 is connected to a first terminal 57 of an "exercise" light 64 while "control switch" terminal 60 and "exercise light" terminal 59 are connected respectively to the input terminals, 52 and 54 of timer 56. A manual control, represented by timer knob 55 is positioned to set the desired "exercise" period. The terminals, 58 and 59 are also connected, respectively, to power leads 30 and 32 of circuit 100 or 120.

Thus, in the embodiment of FIG. 7, the "repetition" circuit 100 or 120 operates only during the "exercise" period controlled by timer 56 because it is only during this period that power is supplied from timer 56 to circuit 100 or 120.

As pointed out above, component 56 may be a delay line where the control switch having terminals 58 and 60 is normally closed. In either case, the photocell light comes on and activates circuit 100 or 120 when power is applied to terminals 52 and 54 of component 56.

Figure 8:
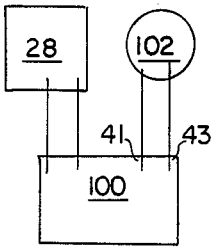
FIG. 8 shows the incorporation of a counter to count repetitions.

If it is desired to count the number of repetitions, then as illustrated in FIG. 8 a counter 102 is connected across the power terminals 41 and 43 of delay line 39 so that when the photocell switch 36 closes by completion of a repetition, a "count" is registered on the counter 102.

Figure 9:
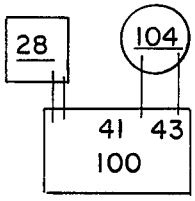
FIG. 9 shows the incorporation of a "power" stopwatch into the circuit to time a single event.

As shown in FIG. 9 and referring to FIG. 2 for details of circuit 100, a single repetition may be timed by attaching the terminals of a "power" stopwatch 104 to power terminals 41 and 43 of delay line 39. When the repetition begins, the photocell switch 36 closes causing the stopwatch 104 to run and when the light beam is interrupted a second time, the stopwatch 104 stops and latches.

Figure 10:
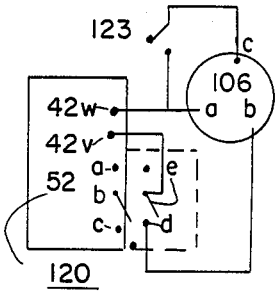
FIG. 10 shows the incorporation of a "pulse" stopwatch into the circuit of FIG. 6 in which the starting position of a single event is different from the position of interruption of the beam.

Alternatively, a single event or a single repetition may be timed by incorporating a "pulse" stopwatch 106 into circuit 120 as discussed with reference to FIG. 10. The first and second stopwatch terminals 106*a* and 106*b*, are connected respectively to "control switch" terminal 42*w* and starter switch terminal 52*d*. Switch 52 is shown in FIG. 10 as double pole double throw. Terminal 52*e* is connected to control switch terminal 42*v*.

Before the start of the single event that is to be timed, the pacer period is set to a negligibly small value and "starter" switch 52 is held in the "momentary" position by the athlete so that terminal 52*a* is disconnected and floating. Terminal 40*w* of control switch 40 is normally closed, i.e., connected to terminal 40*v*. The "mode" switch is in the repetition mode.

When the event starts, the athlete releases the starter switch 52 so stopwatch terminals 106*a* and *b* are shorted for a negligibly short pacer period. When the athlete interrupts the beam by finishing the event, 40*w* is again connected briefly to 40*u* thereby pulsing the stopwatch a second time and stopping the stopwatch.

The stopwatch is reset by manually closing switch 123 momentarily in FIG. 10 and thereby connecting the first terminal 106*a* and the third terminal 106*c*.

Figure 11:
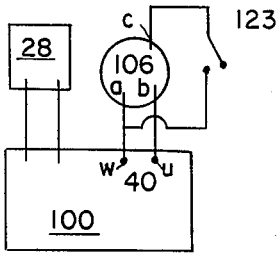
FIG. 11 shows the incorporation of the "pulse" stopwatch into the repetion circuit of FIG. 2 in order to time a single repetition.

In FIG. 11 is shown the use of the pulse stopwatch 106 with repetition circuit 100 wherein the control switch 40 is shown as a doublethrow switch with terminals 40*u* and 40*v* connected as discussed in connection with FIG. 2 and the additional terminal 40*w* which is connected to terminal 40*u* during the pacer period. Terminal 40*w* and 40*u* are connected to the first and second terminals 106*a* and *b* respectively of pulse stopwatch 106. In practice, the pacer period is set to a negligibly low value. Then, when the beam is interrupted at the start of a repetition, terminals 40*u* and *w* connect during the short pacer period to start the stopwatch. Then, they connect again when the beam is broken at the finish of the repetition to stop the watch. The watch is reset by a separate switch between the first and third terminals.

In the foregoing descriptions, the control switch of the delay line has been shown as a double throw double pole switch. It will be obvious to one skilled in the art that for circuit 100, this switch need only be single pole single throw. However, when the pulse stopwatch is introduced for single repetition timing, the switch is double throw. Since commercial units are normally provided with double pole double throw control switches, the control switch is shown as double throw in the above discusion although the various embodiments are not intended to be limited when it is obvious that other switches could be used Several arrangements have been described by which the objects of this invention can be achieved. The descriptions have been intended to be illustrative but were not intended to be exclusive of other arrangements which may become obvious to one skilled in the art after studying the drawings and reading the specification.

I claim:

1. An exercise apparatus which comprises:

a photocell light source having a photocell beam;

a photocell sensor on which shines said photocell beam which is located so that a user performing repetitions of an exercise interrupts said beam shining on said sensor when he assumes a desired position during each repetition and so that a repetition period between successive interruptions of said beam is the time required to perform each repetition;

means for preregistering an arbitrary pacer period;

means for comparing each said repetition period to said pacer period;

a signalling means which emits a signal each time any said repetition period is longer than said pacer period.

2. An exercise apparatus as in claim 1 wherein said means for preregistering said arbitrary pacer period further comprises a variable delay line so that said delay period may be set equal to said desired pacer period.

and wherein said means for comparing further comprises said delay line having power terminals and an output switch connecting a power source to said signalling means and which is open when no power is applied to said power terminals and closes when power is applied longer than a delay period and a photo cell switch which closes when said beam shines on said sensor and which connects a source of power to said power terminals.

3. An exercise apparatus as in claim 2, in which said signalling means further comprises a device selected from the group which consists of a light and noise emitter.

4. An exercise apparatus as in claim 3 which further comprises:

a pulse stopwatch having a first, second and third terminal and wherein said first and second stopwatch terminals are connected through one of said sets of stopwatch terminals closed during said pacer period so that by presetting said pacer period to a negligibly small value a repetition period may be measured by said stopwatch as the time between the end of one pacer period and the beginning of a second pacer period.

5. An exercise apparatus as in claim 3 which further comprises:

a power stopwatch having power input terminals connected across said power terminals of said delay line and means to reset said stopwatch so that said stop watch runs when said beam is not interrupted and stops when said beam is interrupted.

6. An exercise apparatus as in claim 3 which further comprises:

a counter having two terminals connected in parallel with said power input terminals of said delay line so that a count is registered by said counter for every interruption of said beam.

* * * * *